US008632154B2

(12) United States Patent
Aoki et al.

(10) Patent No.: US 8,632,154 B2
(45) Date of Patent: Jan. 21, 2014

(54) INK JET RECORDING METHOD AND RECORDING APPARATUS

(71) Applicant: Seiko Epson Corporation, Tokyo (JP)

(72) Inventors: Katsuko Aoki, Kiso (JP); Yoshiko Azami, Matsumoto (JP); Shoki Kasahara, Shiojiri (JP)

(73) Assignee: Seiko Epson Corporation (JP)

( * ) Notice: Subject to any disclaimer, the term of this patent is extended or adjusted under 35 U.S.C. 154(b) by 0 days.

(21) Appl. No.: 13/773,927

(22) Filed: Feb. 22, 2013

(65) Prior Publication Data

US 2013/0222480 A1 Aug. 29, 2013

(30) Foreign Application Priority Data

Feb. 29, 2012 (JP) ..... 2012-044151

(51) Int. Cl.
*B41J 2/205* (2006.01)

(52) U.S. Cl.
USPC ..... 347/15

(58) Field of Classification Search
USPC ..... 347/12, 15, 14, 41, 102
See application file for complete search history.

(56) References Cited

U.S. PATENT DOCUMENTS

| | | | | |
|---|---|---|---|---|
| 6,902,249 | B2 | 6/2005 | Suzuki et al. | |
| 7,331,648 | B2 * | 2/2008 | Niekawa | 347/41 |
| 7,399,059 | B2 * | 7/2008 | Morooka et al. | 347/42 |
| 7,527,351 | B2 * | 5/2009 | Hirano et al. | 347/42 |

FOREIGN PATENT DOCUMENTS

| | | |
|---|---|---|
| JP | 2003-285427 | 10/2003 |
| JP | 2007-152736 | 6/2007 |
| JP | 2010-221634 | 10/2010 |
| JP | 2011-126125 | 6/2011 |

* cited by examiner

*Primary Examiner* — Lamson Nguyen
(74) *Attorney, Agent, or Firm* — Harness, Dickey & Pierce, P.L.C.

(57) ABSTRACT

An ink jet recording method includes a first process in which a coloring ink is recorded on a recording medium using an ink jet head so as to form a first image, a second process in which a background ink is recorded using the ink jet head so as to form a background image that covers the first image, and a third process in which a coloring ink is recorded using the ink jet head so as to form a second image, and a drying process is included between the first process and the third process.

14 Claims, 3 Drawing Sheets

INK JET RECORDING METHOD AND RECORDING APPARATUS

Priority is claimed under 35 U.S.C. §119 to Japanese Application No. 2012-044151 filed on Feb. 29, 2012, which is hereby incorporated by reference in its entirety.

BACKGROUND

1. Technical Field

The present invention relates to an ink jet recording method and a recording apparatus.

2. Related Art

In the related art, as a recording method for forming images on a recording medium based on image data signals, various systems have been used. Among these, in an ink jet system, since ink is discharged only on necessary image portions using inexpensive apparatuses so as to directly form images on a recording medium, ink can be efficiently used, and the running cost of the system is inexpensive. Further, since the ink jet system generates little noise, it is excellent as a recording method.

In recent years, a recorded product on which images can be observed from both sides has been focused on. Such a recorded product is used for, for example, being attached to a window. For example, JP-A-2007-152736 discloses a method in which an image is recorded on a first face of a recording medium, and then another image is recorded on a second face that is the back face of the first face of the recording medium.

However, when images are recorded on both faces of a recording medium, a transport mechanism for the recording medium becomes complicated. In addition, when an image is recorded on the second face of a recording medium, an image on the first face that has already been recorded inevitably comes into contact or friction with the transport mechanism or the recording medium itself, and thus, there is a problem in that degradation of the image on the first face, or contamination of the transport mechanism or of the recording medium caused by attachment of the image on the first face thereto occurs.

SUMMARY

Thus, an advantage of some aspects of the invention is to provide an ink jet recording method that can create a recorded product on which images can be observed from both sides with ease and with a high quality image.

According to an aspect of the invention, there is provided an ink jet recording method that includes a first process in which a coloring ink is recorded on a recording medium using an ink jet head so as to form a first image, a second process in which a background ink is recorded using the ink jet head so as to form a background image that covers the first image, and a third process in which a coloring ink is recorded using the ink jet head so as to form a second image, and a drying process is included between the first process and the third process.

For example, the drying process may be performed between the second process and the third process. In addition, for example, the drying process may be performed until a drying rate of an image formed on the recording medium reaches 60% or higher.

For example, the first and the second processes may be performed using an ink jet head, and executed at the same time as a transport operation of the recording medium in a first direction, and the third process may be executed at the same time as a transport operation of the recording medium in the direction opposite to the first direction, or after the transport operation in the opposite direction has been completed.

For example, the ink jet head may include a plurality of nozzle columns that extend in the transport direction of the recording medium, and the plurality of nozzle columns may have nozzle columns in which nozzle holes that discharge the coloring inks are arranged and nozzle columns in which nozzle holes that discharge the background ink are arranged, in the first or the third process, the coloring ink may be recorded using nozzle holes of a first group in the nozzle columns of the coloring ink, in the second process, the background ink may be recorded using nozzle holes of a second group in the nozzle columns of the background ink, and the first group and the second group may be differently positioned in the transport direction.

For example, the coloring ink or the background ink may be an aqueous ink containing a color material and a resin. For example, the recording medium may have light transmissivity.

A recording apparatus according to an aspect of the invention may use the ink jet recording method described above.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
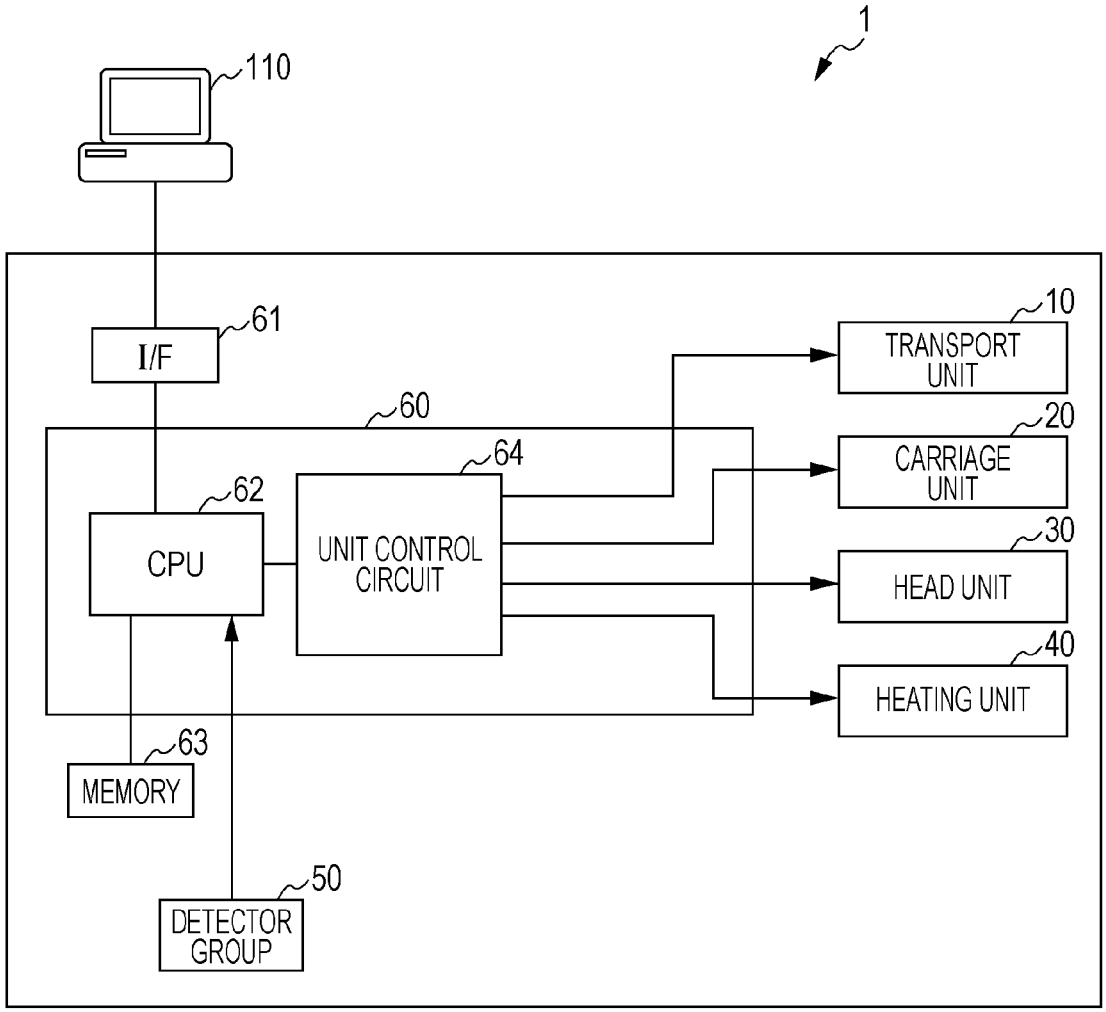
FIG. 1 is a schematic diagram showing a configuration of a recording apparatus used in an embodiment of the invention.

Hereinafter, preferred embodiments of the invention will be described in detail. Note that the invention is not limited to the embodiments below, and can be implemented with various modifications within the scope of the gist of the invention.

Ink Jet Recording Apparatus

An ink jet recording apparatus (hereinafter, referred to simply as a "recording apparatus") according to an embodiment of the invention is not particularly limited only if the apparatus causes ink jet heads (hereinafter, referred to simply as "heads") for discharging a first coloring ink, a background ink, and a second coloring ink to move with respect to a recording medium, and causes the inks to be discharged from the heads so as to perform recording.

Note that the apparatus may be configured to discharge the first coloring ink, the background ink, and the second coloring ink from one head, or may be configured to discharge the first coloring ink, the background ink, and the second coloring ink from separate heads.

As the ink jet recording apparatus, a serial printer of an off-carriage type (hereinafter, referred to simply as a "printer") will be exemplified, and described with reference to drawings. Herein, serial printers perform recording while heads thereof reciprocate in a direction intersecting with a transport direction of a recording medium. Among these, in a serial printer of an off-carriage type, ink cartridges are connected to heads on a carriage via a tube.

Note that, since each member is set in a recognizable size in the drawings used in description below, the scale of each member is appropriately changed.

Figure 2:
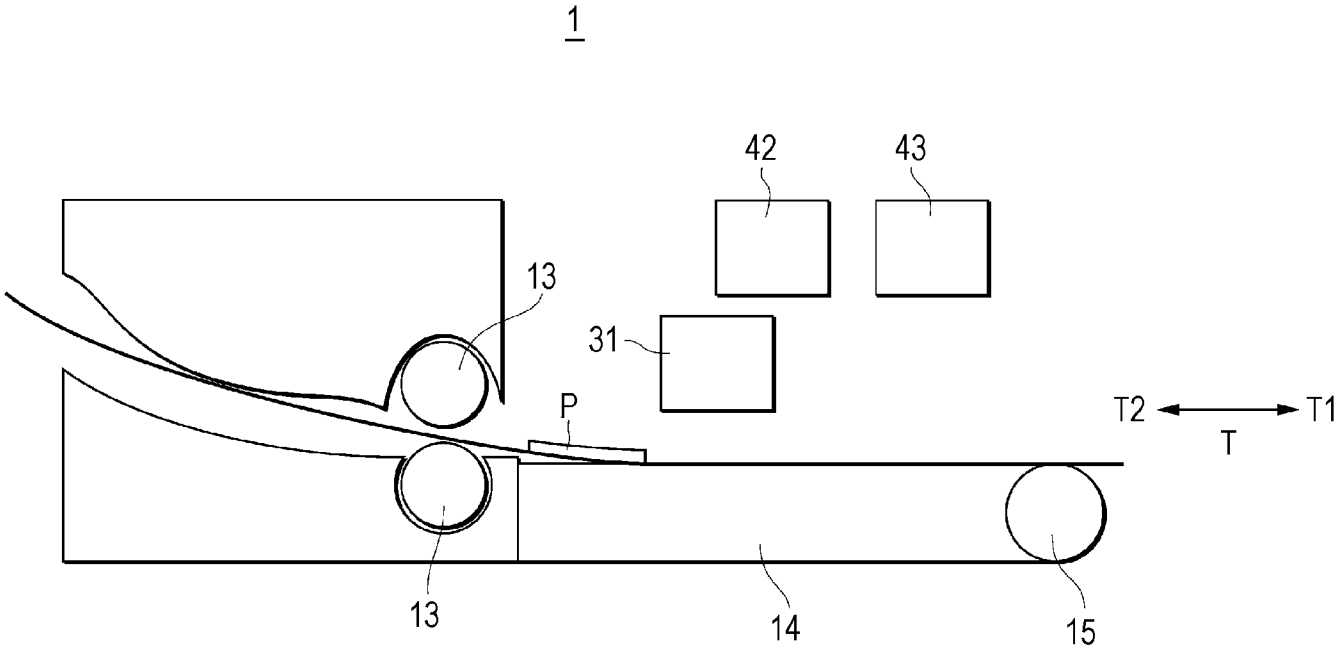
FIG. 2 is a diagram showing a configuration in the periphery of a head of the recording apparatus.

FIG. 1 is a block diagram showing a configuration of a printer 1. FIG. 2 is a schematic cross-sectional diagram in the periphery of heads of the printer 1. Herein, the direction (T) from the left side to the right side of the sheet of FIG. 2 corresponds to the direction in which a recording medium is transported.

The printer 1 according to the embodiment is an apparatus to form images on a transparent recording medium P (hereinafter, referred to simply as a "recording medium") by discharging a first coloring ink, a background ink, and a second coloring ink in this order to the recording medium P. Herein, the printer 1 according to the embodiment can form images using inks of various colors, and as printing using the first coloring ink and the second coloring ink, for example, formation of an image using inks of four colors of CMYK is exemplified. In addition, as printing using the background ink, for example, an excellent masking property is given to the recording medium P using a white ink or a glittering ink.

The printer 1 includes a transport unit 10, a carriage unit 20, a head unit 30, a heater unit 40, a detector group 50, and a controller 60. The printer 1 which receives print data from a computer 110 that is an external device controls each of the units (the transport unit 10, the carriage unit 20, the head unit 30, and the heater unit 40) using the controller 60. The controller 60 controls each of the units based on the print data received from the computer 110 so as to print an image on the recording medium P. The status in the printer 1 is monitored by the detector group 50, and the detector group 50 outputs detection results to the controller 60. The controller 60 controls each of the units based on the detection results output from the detector group 50.

The transport unit 10 is designed to transport the recording medium P such as paper in a predetermined direction (hereinafter, referred to as a "transport direction" or a "sub-scanning direction"). The transport unit 10 includes a paper feeding roller (not shown), a transport motor (not shown), transport rollers 13, a platen 14, and a paper discharging roller 15. The paper feeding roller is a roller for feeding the recording medium P that has been inserted in a paper insertion slot into the printer 1. The transport rollers 13 are rollers for transporting the recording medium P that has been fed by the paper feeding roller to a region in which printing can be performed, and are driven by the transport motor. The platen 14 supports the recording medium P during printing, conveys the recording medium P thereon by driving of a paper conveying motor. The platen is provided with a heater therein, and is configured to be able to heat the recording medium P to a predetermined temperature. The paper discharging roller 15 is a roller for discharging the recording medium P to outside of the printer, and provided on the downstream side of the transport direction in the region in which printing can be performed.

The carriage unit 20 is a movement mechanism in which a head 31 is caused to move, in other words, to perform scanning in a direction (hereinafter, referred to as a "movement direction" or a "main scanning direction") intersecting with the transport direction (sub-scanning direction) while discharging inks on the recording medium P that stands still in a print region. The carriage unit 20 includes a carriage, and a carriage motor. The carriage is provided with the head 31 therein, and is connected to a carriage motor via a timing belt. The ink cartridge is placed in a position separate from the carriage, and is accommodated in a cartridge accommodation unit provided on the outside of the main body of the printer 1 (out of the movement range of the carriage). The ink cartridge is connected to the carriage via an ink supplying tube. In this case, the ink cartridge and the carriage do not move together. Thus, the carriage reciprocates along a guide shaft by the carriage motor while being supported by the guide shaft, to be described later, which intersects with the transport direction. The guide shaft is used to support the carriage so that the carriage can reciprocate in an axial direction of the guide shaft.

The head unit 30 is to discharge the first coloring ink and the second coloring ink to the recording medium P. The head unit 30 includes the head 31 having a plurality of nozzles. Since the head 31 is provided in the carriage, when the carriage moves in a movement direction, the head 31 also moves in the movement direction. Thus, while the head 31 moves in the movement direction, the head discharges the first coloring ink and the second coloring ink to the recording medium P. Accordingly, dot columns are formed on the recording medium P along the movement direction. In this manner, as the head 31 discharges the first coloring ink and the second coloring ink to the recording medium P, the recording apparatus can be simplified.

Note that, in the movement of the head 31, ink compositions are discharged during the movement from one end side to the other end side of FIG. 2. In addition, the discharge of the ink compositions may be performed or may not be performed during the converse movement.

The heater unit 40 heats the ink compositions adhering to (landed on) the recording medium P. Dots formed on the recording medium P completes an image after being heated by the heater 40 so as to be fixed (cured). The heater unit 40 includes a hot air heater 42 on the downstream side of the transport direction adjacent to the head unit 30 and a drying heater 43 on the downstream side of the hot air heater 42 in the transport direction. The hot air heater 42 blows hot air of a desired temperature onto the top face of the recording medium so as to maintain the temperature of the surface of the recording medium to be the desired temperature. The drying heater 43 dries the image, and includes, for example, an infrared heater.

The temperature of the drying heater means a temperature of the surface of the recording medium that comes into contact with the ink compositions. The temperature can be measured using a thermograph on the market. As a specific example of the thermograph, an infrared thermographic device (H2640/H2630 [trade name], made by NEC Avio Infrared Technologies Co., Ltd.) is exemplified.

The detector group 50 includes a linear encoder, a rotary encoder, a paper detection sensor, an optical sensor, and the like. The linear encoder detects a position of the carriage in the movement direction. The rotary encoder detects a rotation amount of the transport roller 13. The paper detection sensor detects the position of the leading end of a sheet (recording medium P) being fed. The optical sensor detects a presence or absence of the recording medium P using a light emitting unit and a light sensing unit installed in the carriage. Then, the optical sensor detects the positions of the end portions of the recording medium P while being moved by the carriage so as to detect the width of the recording medium P. In addition, the optical sensor can also detect the leading end (which is the end portion on the downstream side of the transport direction and referred to as an upper end) and the tail end (which is the end portion on the upstream side of the transport direction and referred to as a lower end) of the recording medium P depending on circumstances.

The controller 60 is a control unit (control section) for controlling the printer 1. The controller 60 has an interface section 61, a CPU 62, a memory 63, and a unit control circuit 64. The interface section 61 performs transmission and reception of data between the computer 110 that is an external device and the printer 1. The CPU 62 is an arithmetic operation processing unit for controlling the whole printer 1. The memory 63 is to secure an area for storing programs of the CPU 62, a work area, and the like, and has storage elements such as a RAM, or EEPROM. The CPU controls each unit via the unit control circuit 64 in accordance with the programs stored in the memory 63.

When printing is performed, the controller 60 repeats a dot formation operation in which the ink compositions are discharged from the head 31 moving in the main scanning direction and a transport operation in which the recording medium P is transported in the transport direction in an alternate manner, and thereby printing an image constituted by a plurality of dots (including an overcoating image) on the recording medium P.

In this manner, the ink jet recording apparatus using the ink compositions forms an image in a region of the recording medium P facing the head 31.

Modification Example of Ink Jet Recording Apparatus

The above-described recording apparatus is a serial printer of an off-carriage type. Although not shown in the drawings, when a large-capacity ink tank is added to the outside of the printer 1, an ink supplying tube connects the large-capacity ink tank and the ink cartridge. Accordingly, the reserved amount of the ink compositions can be remarkably increased in the printer 1 of the off-carriage type in the same manner as in a printer of an on-carriage type.

In addition, the recording apparatus of the embodiment may be a serial printer of an on-carriage type in which an ink cartridge (ink tank) is mounted on the carriage together with the head 31. In the case of the on-carriage type, the carriage holds the ink cartridge (not shown) that contains the ink compositions in an attachable and detachable manner.

In addition, the recording apparatus of the embodiment may be a line printer that performs recording without causing the head to move at all. In this case, an equal number of line heads and types of the ink compositions are necessary due to the configuration of the printer.

Ink Jet Recording Method

Figure 3:
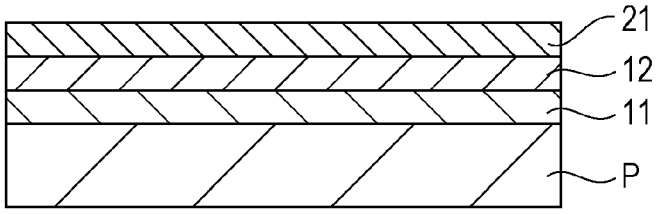
FIG. 3 is a schematic cross-sectional diagram of a recorded product.

In the ink jet recording method according to an embodiment of the invention (hereinafter, referred to simply as a "recording method"), recording can be performed using the above-described ink jet recording apparatus. FIG. 3 is a cross-sectional diagram of a recorded product formed using the ink jet recording method.

The ink jet recording method according to the embodiment includes, first, a first process in which a first image 11 is formed by recording the first coloring ink on the recording medium P that has light transmissivity using the head 31, a second process in which a background image 12 that covers the first image 11 is formed by recording the background ink using the head 31, and a third process in which a second image 21 is formed by recording the second coloring ink using the head 31. In addition, a drying process is included between the first process and the third process. As will be described later, it is preferable to perform the drying process between the first process and the second process.

Hereinbelow, a recording method in which transport of the recording medium P is performed in the direction opposite to the transport direction, that is, a recording method that adopts backfeeding will be described, and each of the above-described processes will be described with reference to FIG. 2. The drawing shows a configuration in the periphery of the head of the recording apparatus.

First and Third Processes

In the first and the third processes, the first coloring ink is recorded on a transparent recording medium using the head 31 so as to form an image. In the case of the recording method that adopts backfeeding, as shown in FIG. 2, the first process is executed when the recording medium is transported in a T1 direction, and the third process is executed when the recording medium is transported in a T2 direction, or the first process is executed, then the recording medium is returned to the initial position again, and then the third process is executed while the recording medium is transported in the T1 direction again. In this case, it is preferable to execute the third process while the recording medium is transported in the T1 direction again.

Herein, in the recording method using a serial printer, multi-pass printing having two or a higher number of pass times (the number of main scanning times) is possible. By forming an image by overcoating ink in two divided times in the multi-pass printing, the image having higher quality can be formed.

Second Process

It is preferable to perform the second process at the same time as the first process and/or the third process. When the second process is performed at the same time as the first process, the first process is executed in the upstream portion of the head 31 while the recording medium is transported in the T1 direction, and the second process is performed in the downstream portion of the head 31. When the second process is performed at the same time as the third process, for example, the second process is executed in the upstream portion of the head 31 while the recording medium is transported in the T1 direction, and the third process is executed in the downstream portion of the head 31. Note that the second process may be performed at the same time as the third process while the recording medium is transported in the T2 direction.

Figure 4:
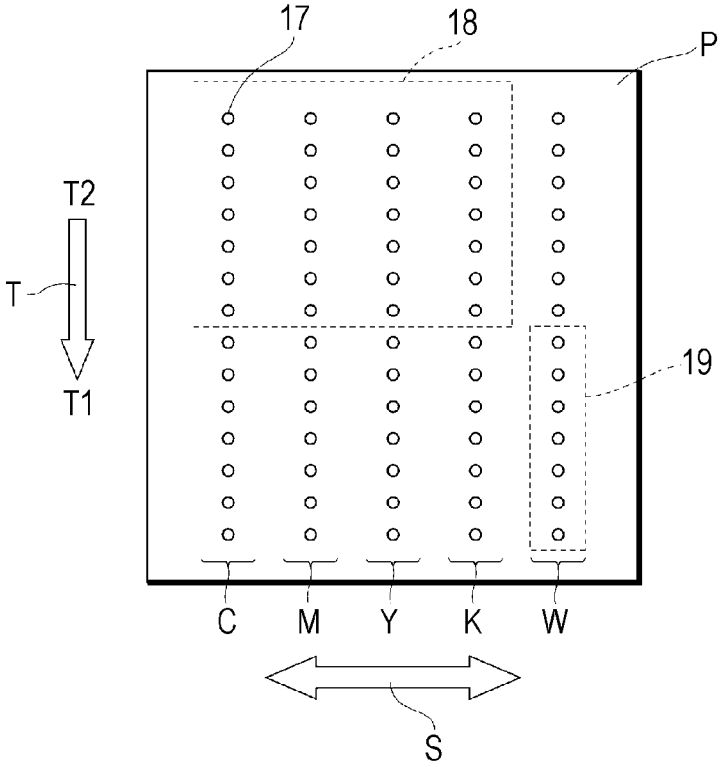
FIG. 4 is a diagram showing an example of nozzles of the head of the recording apparatus.

FIG. 4 is a diagram for describing a configuration of the head for performing the second process at the same time as the first process and/or the third process and the ink jet recording method using the head.

As shown in FIG. 4, the head 31 includes a plurality of nozzle columns that extends in the transport direction T of the recording medium P, and the plurality of nozzle columns includes nozzle columns in which nozzle holes that discharge coloring inks, which are CMYK herein, are arranged and nozzle holes that discharge a background ink W.

When the first and the second processes are executed at the same time, and the third process is independently executed, for example, the coloring inks are recorded using a group 18 that includes the desired number of rows among the nozzle columns of the coloring inks C, M, Y, and K while the recording medium is transported in the T1 direction (first process). Then, the background ink is recorded using a group 19 corresponding to the number of rows different from the group 18 among the nozzle column of the background ink (second process). In this case, in the third process, the coloring inks can be recorded using the entire nozzle columns of the coloring inks C, M, Y, and K.

Alternatively, when the first process is independently executed, and the second and the third processes are executed at the same time, first, the recording medium P is transported in the T1 direction, and the coloring inks are recorded using the entire rows of the nozzle columns of the coloring inks C, M, Y, and K. Then, the recording medium is transported in the T2 direction, so as to return the recording medium P to a predetermined position, then transported in the T1 direction, and then the background ink is recorded using a group of rows on the upstream side among the nozzle column of the background ink (second process). In addition, the coloring inks are recorded using a group of rows on the downstream side among the nozzle columns of the coloring inks C, M, Y, and K (third process).

Alternatively, when the first and the second processes are executed at the same time, and then the second and the third processes are further executed at the same time, first, while the recording medium P is transported in the T1 direction, the coloring inks are recorded (first process) using the group 18 on the upstream side of the nozzle columns of the coloring inks C, M, Y, and K, and the background ink is recorded using the group 19 on the downstream side of the nozzle column of the background ink W (second process). Further, while the recording medium P is transported in the T2 direction (backfeeding process) so as to return the recording medium P to a predetermined position, and then transported in the T1 direction to record the background ink thereon using the group on the upstream side of the nozzle column of the background ink W (second process), and to record the coloring inks using the group on the downstream side of the nozzle columns of the coloring inks C, M, Y, and K (third process). Note that the second and the third processes may be performed while the recording medium is transported in the T2 direction.

As described above, in the recording method according to the embodiment, the speed of recording can be raised by dividing and then using the nozzle columns. In addition, if the nozzle columns are divided and then used, the number of backfeeding times of the recording medium can be reduced. Accordingly, deviation of printing positions that may occur due to the backfeeding of the recording medium can be reduced.

Drying Process

The ink jet recording method according to the embodiment includes a drying process between the first process and the third process. For example, cases in which the first and the second processes are executed at the same time, then the drying process is performed, and then the third process is independently executed, in which the first process is independently executed, then the drying process is performed, and the second and the third processes are executed at the same time, and in which the first and the second processes are executed at the same time, then the drying process is performed, and then the second and the third processes are further executed are exemplified.

The "drying process" in the specification refers to a process performed by stopping a recording medium for a given period of time and sufficiently heating the surface of the recording medium using the drying heater 43, or a process in which a drying rate of 60% or higher is attained for sufficient drying. Thus, drying for a short period of time performed only during execution of a recording process using a heater provided in a platen facing a recording head does not fall within the drying process in the invention.

The drying process is set with a drying rate that is preferably 70% or higher. Accordingly, bleeding generated between an image derived from the first coloring ink and the second coloring ink can be further preferably prevented. In addition, if drying is completely performed by setting the drying rate to be 100%, the background ink is solidified leaving solids, but if the second coloring ink is recorded on the solidified portion, bleeding occurs in printing, and thus, the drying rate of 95% or lower is preferable.

Note that the "drying rate" in the specification is computed by dividing the mass of the ink compositions after drying by the mass of the ink compositions during discharge. In addition, the drying rate in the above-described drying process is measured and computed in the following manner.

The mass of a recording medium immediately after an ink is given to the recording medium to form an image corresponds to the drying rate of 0%. In addition, the time point at which there is substantially no change in the mass of the recording medium by drying an image under a predetermined drying condition corresponds to the drying rate of 100%. Using the two kinds of data and mass data of a recording medium obtained by changing a drying time, or the like (intermediate drying rate), a change in a drying rate with respect to a change in the mass of the recording medium can be expressed. Based on the result and the mass of the recording medium obtained in that way, a drying rate can be computed.

The temperature during the drying is preferably equal to or higher than an MFT of a resin included in the first coloring ink. In this case, since the resin is melted and there is (almost) no rough or uneven feeling on the image, the image quality is enhanced. A specific drying temperature is preferably equal to or higher than 70° C. and lower than or equal to 120° C., and more preferably equal to or higher than 80° C. and lower than or equal to 110° C. in order to satisfy all of the conditions.

According to the above-described ink jet recording method according to the embodiment, since an image formed by using the first coloring ink, an image formed by using the background ink, and an image formed by using the first or the second coloring ink are superimposed on one side face of a recording medium, the problems of complexity of a transport mechanism and contamination caused by the images which would be problems if images are formed on both faces of a recording medium can be avoided. In addition, since images formed on both sides of a background image can be shielded by the background image, a recorded product that can be observed from both sides can be formed. Further, by arranging a drying process at least before the process of forming an image using the second coloring ink, an image formed until that time is smoothed, and degradation of the image of the second coloring ink can thereby be suppressed.

Ink Compositions

The above-described ink compositions (including the coloring inks and the background ink, and the same applies below) are used in the ink jet recording method according to the embodiment. The coloring inks are, for example, coloring inks of CMYK, and the background ink is a white or a glittering ink. Hereinafter, additives (components) that are contained or can be contained in the ink compositions will be described.

Color Material of Coloring Ink

A coloring ink contains a color material. A color material can use at least one of a pigment and a dye.

Pigment

By using a pigment as a color material, a light resistance property of an ink composition can be improved. For the pigment, both of an inorganic pigment and an organic pigment can be used.

As an inorganic pigment, carbon black (C.I. pigment black 7) such as a furnace black, lamp black, acetylene black, or channel back, an iron oxide, or a titanium oxide can be used.

As an organic pigment, an azo pigment such as an insoluble azo pigment, a condensed azo pigment, an azo lake, or a chelate azo pigment, a polycyclic pigment such as a phthalocyanine pigment, a perylene and a perinone pigment, an anthraquinone pigment, a quinacridone pigment, a dioxane pigment, a thioindigo pigment, an isoindolinone pigment, or a quinophthalone pigment, a dye chelate (for example, a basic dye-type chelate, an acidic dye-type chelate, or the like), a dye lake (a basic dye-type lake, or an acidic dye-type lake), a nitro pigment, a nitroso pigment, aniline black, or a daylight fluorescent pigment is exemplified.

To further specifically describe, as carbon black used in a black ink, No. 2300, No. 900, MCF88, No. 33, No. 40, No. 45, No. 52, MA7, MA8, MA100, No. 2200B, and the like (which are manufactured by Mitsubishi Chemical Corporation), Raven 5750, Raven 5250, Raven 5000, Raven 3500, Raven 1255, Raven 700, and the like (which are manufactured by Columbian Chemicals Company), Regal 400R, Regal 330R, Regal 660R, Mogul L, Monarch 700, Monarch 800, Monarch 880, Monarch 900, Monarch 1000, Monarch 1100, Monarch 1300, Monarch 1400, and the like (which are manufactured by Carbot Corporation), and Color Black FW1, Color Black FW2, Color Black FW2V, Color Black FW18, Color Black FW200, Color Black S150, Color Black S160, Color Black S170, Printex 35, Printex U, Printex V, Printex 140U, Special Black 6, Special Black 5, Special Black 4A, and Special Black 4 (which are manufactured by Evonic Degussa GmbH) are exemplified.

As a pigment used in a yellow ink, C.I. pigment yellow 1, 2, 3, 4, 5, 6, 7, 10, 11, 12, 13, 14, 16, 17, 24, 34, 35, 37, 53, 55, 65, 73, 74, 75, 81, 83, 93, 94, 95, 97, 98, 99, 108, 109, 110, 113, 114, 117, 120, 124, 128, 129, 133, 138, 139, 147, 151, 153, 154, 167, 172, or 180 is exemplified.

As a pigment used in a magenta ink, C.I. pigment red 1, 2, 3, 4, 5, 6, 7, 8, 9, 10, 11, 12, 14, 15, 16, 17, 18, 19, 21, 22, 23, 30, 31, 32, 37, 38, 40, 41, 42, 48 (Ca), (Mn), 57 (Ca), 57:1, 88, 112, 114, 122, 123, 144, 146, 149, 150, 166, 168, 170, 171, 175, 176, 177, 178, 179, 184, 185, 187, 202, 209, 219, 224, or 245, or C.I. pigment violet 19, 23, 32, 33, 36, 38, 43, or 50 is exemplified.

As a pigment used in a cyan ink, C.I. pigment blue 1, 2, 3, 15, 15:1, 15:2, 15:3, 15:34, 15:4, 16, 18, 22, 25, 60, 65, 66, or C.I. bat blue 4, or 60 is exemplified.

In addition, as a pigment other than magenta, cyan, and yellow, for example, C.I. pigment green 7, or 10, C.I. pigment brown 3, 5, 25, or 26, or C.I. pigment orange 1, 2, 5, 7, 13, 14, 15, 16, 24, 34, 36, 38, 40, 43, or 63 is exemplified.

The above-described pigments may be used singly or two or more kinds thereof may be used together.

When the above-described pigments are used, an average particle diameter thereof is preferably 300 nm or smaller, and more preferably 50 nm to 200 nm. When the average particle diameter falls within the above-described range, reliability in discharge stability and dispersion stability of an ink composition is more excellent, and accordingly, an image having an excellent quality can be formed. Herein, the average particle diameter in the specification is measured using a dynamic light scattering method.

Dye

A dye can be used as a color material. A dye is not particularly limited, but an acidic dye, a direct dye, a reactive dye, or a basic dye can be used. As a dye, for example, C.I. acid yellow 17, 23, 42, 44, 79, or 142, C.I. acid red 52, 80, 82, 249, 254, or 289, C.I. acid blue 9, 45, or 249, C.I. acid black 1, 2, 24, or 94, C.I. food black 1, or 2, C.I. direct yellow 1, 12, 24, 33, 50, 55, 58, 86, 132, 142, 144, or 173, C.I. direct red 1, 4, 9, 80, 81, 225, or 227, C.I. direct blue 1, 2, 15, 71, 86, 87, 98, 165, 199, or 202, C.I. direct black 19, 38, 51, 71, 154, 168, 171, or 195, C.I. reactive red 14, 32, 55, 79, 249, or C.I. reactive black 3, 4, or 35 is exemplified.

The above-described dyes may be used singly, or two or more kinds thereof may be used together.

The content of a color material is preferably 1 to 20 mass % of the total mass (100 mass %) of an ink composition in order to obtain excellent masking property and color reproduction property.

Color Material of Background Ink

As a color material of the background ink, for example, a white pigment, or a glittering pigment can be used.

As a white pigment, for example, resin particles having a hollow structure, or metal oxide particles such as titanium dioxide, zinc oxide, silica, alumina, magnesium oxide, or zirconium oxide is exemplified.

As a glittering pigment, metal particles of aluminum, silver, gold, platinum, nickel, chromium, tin, zinc, indium, titanium, or copper, or a pigment having pearlescence or interference gloss such as titanium dioxide coated mica, argentine, or bismuth oxychloride is exemplified.

Dispersing Agent

When an ink composition contains a pigment, a dispersing agent may be further contained therein in order to have a more satisfactory pigment dispersing property. There is no particular limit on a dispersing agent, but for example, a dispersing agent such as a polymeric dispersing agent that is practically used in preparing a pigment dispersion liquid is exemplified. As a specific example, a dispersing agent having one or more of the following among polyoxyalkylene polyalkylene polyamine, a vinyl-based polymer and copolymer, acrylic polymer and copolymer, polyester, polyamide, polyimide, polyurethane, an amino-based polymer, a silicon-containing polymer, a sulfur-containing polymer, a fluorine-containing polymer, and an epoxy resin as main components is exemplified. As commercial products of polymeric dispersing agents, the AJISPER series manufactured by Ajinomoto Fine-Techno Co., Inc., the SOLSPERSE series (Solsperse 36000) available from NITTO DENKO Avecia Inc., and Noveon, the DISPERBYK series manufactured by BYK Chemie, and the DISPARLON series manufactured by Kusumoto Chemicals, Ltd. are exemplified.

Resin

An ink composition contains a resin (resin particles). By causing an ink composition to contain a resin, an excellent anti-abrasion property of an image can be attained.

Particularly, when the above-described drying process is performed, a thermal deformation temperature of a resin is preferably lower than or equal to the drying temperature. If the thermal deformation temperature is lower than or equal to the drying temperature, the resin is melted, and the surface of an image is almost smoothed, and thus, the quality of an image formed thereon becomes excellent.

Although there is no limit on the following resins, but for example, a polyester resin such as an aliphatic polyester resin, an aromatic polyester resin, a vinyl resin such as a polyvinyl chloride resin, a polyvinyl acetate resin, and a polyvinyl alcohol resin, a vinyl chloride-vinyl acetate resin, an ethylene-vinyl acetate resin, a polyvinyl butyral resin, a cellulose resin such as an ethyl cellulose resin, a cellulose acetate propionate resin, and a nitrocellulose resin, a (meth)acrylic resin such as a poly(meth)acrylic resin, a polymethyl(meth) acrylic resin, and a polyethyl(meth)acrylic resin, an ethylene-(meth)acrylic resin, a styrene-(meth)acrylic resin, an ethylene-ester(meth)acrylic resin, a urethane resin, a polystyrene resin, a polycarbonate resin, a phenoxy resin, a polyamide resin, a polyimide resin, a polysulfone-based resin, a petroleum resin, a chlorinated polypropylene resin, a polyolefin resin, an ethylene alkyl(meth)acrylate resin, a rosin-modified phenol resin, various kinds of synthetic rubber such as NBR, SBR, and MBR, and a modified product thereof are exemplified. If a resin includes these components, gloss and anti-abrasion property of an overcoated image can be excellent. In addition, clogging stability of a head can be excellent, and an overcoated image with an excellent quality over a long period of time can be formed.

Among these, in order to be excellent in durability, one or more kinds selected from an acrylic resin, a urethane resin, a polyester resin, and a styrene-acrylic resin are preferable.

In addition, among the resins, one that can form an emulsion is preferable. If one that can form an emulsion is selected as a resin, the second coloring ink can be more effectively fixed onto images formed using the first coloring ink and the background ink due to film formation caused by drying.

For a resin, any one of an anionic, a non-ionic, and a cationic resin may be used. Among these, a non-ionic or a cationic resin is preferable in terms of a material appropriate for the head.

For resins, one kind thereof may be individually used, or two or more kinds thereof may be used together.

The content of a resin is preferably 1 to 30 mass %, or more preferably 2 to 10 mass % of the total mass (100 mass %) of a coloring ink. If the content falls within the above-described range, gloss and anti-abrasion property of an image can be further excellent.

Paraffin Wax Emulsion

The inks of the embodiment may contain a paraffin wax emulsion. Accordingly, slipping performance is given to a recorded product, and a corresponding ink thereby becomes excellent in anti-abrasion property. Note that, since paraffin wax has a water repellant property, it can enhance a waterproof property of a recorded product.

"Paraffin wax" referred in the specification means so-called petroleum-based wax, having, as a main component, linear paraffin-based hydrocarbons (normal paraffin) having carbon atoms of about 20 to 30, and means a mixture of hydrocarbons containing a little amount of isoparaffin and having a weight-average molecular weight of about 300 to 500.

With the inks of the embodiment that contains paraffin wax in the form of an emulsion, the viscosity of the inks can be easily adjusted to a range appropriate for the ink jet recording method, and more excellent preservation stability and discharge stability of the inks can be acquired.

The melting point of a paraffin wax emulsion is preferably set to 110° C. or lower in order to further strengthen a coated layer of a recorded product and enhance the anti-abrasion property of an image. On the other hand, the lower limit of the melting point of the paraffin wax emulsion is preferably set to 60° C. or higher in order to prevent a dried recorded face from being sticky. Further, the melting point above is preferably set to 70° C. to 95° C. in order to further enhance the discharge stability of an ink.

An average particle diameter of the paraffin wax emulsion is preferably set to be the range of 5 nm to 400 nm, or more preferably set to be the range of 50 nm to 200 nm in order to further enhance a stable emulsion state, and the preservation stability and the discharge stability of an ink. As a paraffin wax emulsion, a commercial product thereof may be used as is. There is no limit on the commercial product, but for example, AQUACER537, and AQUACER539 (which are trade names, and manufactured by BYK Chemie) are exemplified.

The content (converted into a solid) of the paraffin wax emulsion in each of the inks included in an ink set is preferably set to be in the range of 0.1 to 3 mass %, more preferably set to be in the range of 0.3 to 3 mass %, and even more preferably set to be in the range of 0.3 to 1.5 mass % of the total mass (100 mass %) of the ink, separately for each ink. If the content falls within the above-described ranges, an image having more excellent anti-abrasion property, blocking resistance property, and water repellant property can be formed to a recording medium having non-ink absorbing property or low ink absorbing property, and an ink that is excellent in preventing clogging can be obtained.

Polyethylene Wax Emulsion

The inks of the embodiment may contain a polyethylene wax emulsion. Accordingly, an excellent anti-abrasion property of the inks can be obtained.

To exemplify a preparation method of a polyethylene wax emulsion, polyethylene wax is prepared by polymerizing ethylene or by performing thermal decomposition for polyethylene for general molding so as to make it have a low molecular weight. Then, this polyethylene wax is oxidized, a carboxyl group and a hydroxyl group are added thereto, then emulsification is performed using a surfactant, and thereby a polyethylene wax emulsion is obtained in the form of aqueous wax that has excellent stability.

As a polyethylene wax emulsion, a commercial product thereof may be used as is. There is no limit on the commercial products, but for example, Nopcoat PEM17 (trade name, manufactured by SAN NOPCO LIMITED), Chemipal W4005 (trade name, manufactured by Mitsui Chemicals, Inc.), AQUACER513, AQUACER515, and AQUACER593 (which are trade names, manufactured by BYK Chemie) are exemplified.

An average particle diameter of the polyethylene wax emulsion is preferably set to be in the range of 5 nm to 400 nm, and more preferably set to be in the range of 50 nm to 300 nm in order to further enhance the preservation stability and discharge stability of the inks.

The content (converted into a solid) of the polyethylene wax emulsion in each of the inks included in an ink set is preferably set to be in the range of 0.1 to 3 mass %, more preferably set to be in the range of 0.3 to 3 mass %, and even more preferably set to be in the range of 0.3 to 1.5 mass % of the total mass (100 mass %) of the ink, separately for each ink. If the content falls within the above-described ranges, the inks can be satisfactorily solidified and fixed onto a recording medium having non-ink absorbing property or low ink absorbing property, and more excellent preservation stability and discharge stability of the inks can be obtained.

The ranges of respective preferred content of the paraffin wax emulsion and polyethylene wax emulsion are as described above. In addition, the total content (converted into a solid) of the paraffin wax emulsion and polyethylene wax emulsion contained in each of the ink included in an ink set is preferably set to be in the range of 0.4 to 1.6 mass % of the total mass (100 mass %) of the ink, separately for each ink.

Other Wax

The inks of the embodiment may contain wax other than the paraffin wax emulsion and polyethylene wax emulsion (hereinafter, referred to as "other wax"). Wax has a function of giving slipping performance onto the surface of a formed recorded product so as to impart a satisfactory anti-abrasion property. The wax is preferably contained in an ink in the form of an emulsion. With the wax contained in an ink in the form of an emulsion, the viscosity of the ink can be easily adjusted to a range appropriate for the ink jet recording method, and more excellent preservation stability and discharge stability of the ink can be acquired.

There is no limit on other wax, but polyolefin wax (excluding the polyethylene wax described above) is an example, and polypropylenen wax is preferable. A commercial product may be used as is for other wax.

An average particle diameter of other wax is preferably set to be in the range of 5 nm to 400 nm, and more preferably set to be in the range of 50 nm to 200 nm in order to further enhance the preservation stability and discharge stability of an ink.

Surfactant

The ink compositions of the embodiment may contain a surfactant. As the surfactant, an acetylene glycol-based surfactant, or a polysiloxane-based surfactant is preferably used. The acetylene glycol-based surfactant, or the polysiloxane-based surfactant can make permeability of the ink compositions satisfactory by making affinity (wettability) for a recording face of a recording medium good.

As the acetylene glycol-based surfactant, commercial products can be used, and for example, olefin E1010, STG, and Y (which are trade names, manufactured by Nissin Chemical Industry Co., Ltd.), and Surfynol 104, 82, 465, 485, and TG (which are trade names, manufactured by Air Products and Chemicals Inc.) are exemplified.

As the polysiloxane-based surfactant, commercial products can be used, and for example, BYK-347, BYK-348 (which are trade names, manufactured by BYK Chemie), and the like are exemplified.

Furthermore, the ink compositions can contain other surfactants such as an anionic surfactant, a non-ionic surfactant, or an amphiprotic surfactant.

With regard to the surfactant, one kind thereof may be independently used, or two or more kinds thereof may be used together.

The content of a surfactant is not particularly limited, but is preferably about 0.1 to 1.0 mass % of the total mass (100 mass %) of the ink compositions.

Water Soluble Organic Solvent

For the purpose of preventing clogging in the periphery of the nozzles of the head, the ink compositions may contain a water soluble organic solvent (wetting agent) to give a moistening effect. Though the wetting agent is not limited to the following examples, but for example, polyvalent alcohols such as 1,2-hexanediol, glycerin, 1,2,6-hexanetriol, trimethylolpropane, ethylene glycol, propylene glycol, butylene glycol, diethylene glycol, triethylene glycol, tetraethylene glycol, pentaethylene glycol, dipropylene glycol, 2-butene-1,4-diol, 2-ethyl-1,3-hexanediol, 2-methyl-2,4-pentanediol, sugars such as glucose, mannose, fructose, ribose, xylose, arabinose, galactose, aldonic acid, glucitol (sorbitol), maltose, cellobiose, lactose, sucrose, trehalose, and maltotriose, a so-called solid wetting agent such as sugar alcohols, hyaluronic acids, and ureas, alkyl alcohols having carbon atoms of 1 to 4 such as ethanol, methanol, butanol, propanol, and isopropanol, so-called amino acid such as pyrrolidone carboxylic acid, aspartic acid, glycine, proline, and betaine, 2-pyrolidone, N-methyl-2-pyrolidone, 1,3-dimethyl-2-imidazolidinone, formamide, acetamide, dimethyl sulfoxide, sorbitol, sorbitan, acetin, diacetin, triacetin, and sulfolane are exemplified.

With regard to the water soluble organic solvent, one kind thereof may be independently used, or two or more kinds thereof may be used together.

In order to secure an appropriate physical property (viscosity, or the like) of an ink, and satisfactory printing quality and reliability, the content of the water soluble organic solvent is preferably about 5 to 30 mass % of the total mass (100 mass %) of the ink compositions.

Water

The ink compositions of the embodiment may preferably contain water as a main solvent. As water, for example, pure water including ion-exchanged water, ultrafiltered water, reverse osmosis water, and distilled water, and ultrapure water are exemplified. Among these, water that has undergone a sterilization process using radiation of infrared rays or addition of hydrogen peroxide is preferable so as to achieve long-term preservation of the ink compositions by preventing the generation of fungi and bacteria.

Other Additives

The ink compositions of the embodiment may contain additives other than the above (other additives). As such additives, for example, a pH adjuster, a preservative/mildew-proof agent, a penetration-enhancing agent such as glycol ether, and the like, an antioxidant, and the like are exemplified.

Recording Medium

The recording medium used in the recording method of the embodiment is a transparent recording medium, and for example, a recording medium having non-ink absorbability or low absorbability.

The "recording medium having non-ink absorbability or low absorbability" described above refers to a recording medium that does not include an ink absorbing layer (acceptive layer), or a recording medium that includes an absorbing layer only having a thickness to the extent that is not sufficient for exhibiting the function as an absorbing layer. To more quantitatively describe, this "recording medium having non-ink absorbability or low absorbability" refers to a recording medium having a recording face of which the water absorption amount is 10 $mL/m^2$ or less within 30 $msec^{1/2}$ from the beginning of contact based on Bristow method.

The Bristow method described above is disclosed in "Paper and Paperboard—Liquid Absorbability Test Method—Bristow Method" of Standard No. 51 of "2000 Paper-Pulp Test Method of JAPAN TAPPI". This Bristow method is, to be brief, is a method for measuring a behavior of moistening of a liquid onto a surface of a recording medium and subsequent penetration of the liquid into the recording medium for a short period of time such as a unit of millisecond, and an absorption coefficient Ka [unit of $mL/m^2 \cdot (msec^{1/2})$] from an absorption time and a transition amount is obtained by liquid from a head box is dynamically transitioned to a test piece on a rotary wheel.

There is no limit on a recording medium having non-ink absorbability, but for example, a medium obtained by coating plastic on and a medium obtained by attaching a plastic film to a base material such as a plastic film of which the surface has not been processed for ink jet recording, in other words, that does not have an ink absorbing layer are exemplified. Although the plastic is not limited on the following materials, for example, polyvinyl chloride, polyester, polyethylene terephthalate, polycarbonate, polystyrene, polyurethane, polyethylene, and polypropylene are exemplified.

Example 1

Hereinafter, the embodiment of the invention will be described in more detail using examples, but the embodiment is not limited only on the examples.

Preparation of Pigment Dispersion Liquid

Pigment dispersion liquid for cyan, yellow, magenta, and black used in the coloring inks was prepared in the following manner. As for color materials to be used, pigment blue 15:3 for the cyan color material, pigment yellow 74 for the yellow color material, pigment red 122 for the magenta color material were used, and carbon black was used for the black color material.

Then, 40 parts by mass of an aqueous resin (a resin obtained by copolymerizing methacrylic acid, butyl acrylate, styrene, hydroxyethyl acrylate at the ratios by mass of 25:50:

15:10, a weight-average molecular weight of 12,000) was input into a liquid obtained by mixing 7 parts by mass of potassium hydroxide, 23 parts by mass of water, and 30 parts by mass of triethylene glycol-mono-n-butyl ether, the liquid was heated while being agitated at 80° C., and an aqueous resin solution was thereby prepared. To 1.75 kg of the aqueous resin solution (43% of solids), 3.0 kg of a color material and 10.25 kg of water were added, premixing was performed agitating the mixture using an agitator, and a mixed liquid was thereby obtained. Using a horizontal bead mill that is provided with a multi-disc-type impeller which is filled with 85% of zirconia beads having a diameter of 0.5 mm and has an effective volume of 1.5 litters, the above-described mixed liquid was dispersed using a multi-pass method. Specifically, 2-pass was performed in the discharge amount of 30 litters for one hour at a bead circumferential speed of 8 m/second, and then a pigment dispersion mixed liquid having an average particle diameter of 325 nm was obtained. Next, using a horizontal annular bead mill that is filled with 95% of zirconia beads having a diameter of 0.05 mm and has an effective volume of 1.5 litters, circulation dispersion of the pigment dispersion mixed liquid was performed. A screen of 0.015 mm was used, a dispersion process was performed for 10 kg of the pigment dispersion mixed liquid with a circulation amount of 300 litters at a bead circumferential speed of 10 m/second for four hours, and then an aqueous pigment dispersion liquid having 20% of a pigment content and 5% of an aqueous resin was obtained.

Preparation of Dispersion Liquid of Background Ink

A dispersion liquid having titanium dioxide to be used in a white ink as the background ink was prepared according to the following method. 25 parts by mass of a copolymer of solid acrylic acid, n-butyl acrylate, benzyl methacrylate, and styrene having a glass-transition temperature of 40° C., a mass-average molecular weight of 10,000, and an acid number of 150 mg KOH/g was dissolved in a mixed solution of 75 parts by mass of diethylene glycol diethyl ether, and a polymer dispersant solution having 25 mass % of a resin solid was thereby obtained.

19 mass % of diethylene glycol diethyl ether was added to 36 mass % of the polymer dispersant solution to be mixed so as to prepare resin varnish for dispersion of titanium dioxide, 45 mass % of titanium dioxide (CR-90, alumina-silica processed (0.5 of alumina-silica), an average particle diameter based on a volume of 300 nm, an oil absorption amount of 21 ml/100 g, manufactured by ISHIHARA SANGYO KAISHA, LTD.) was further added thereto, mixed with agitation, and kneading was performed using a wet circulation mill, thereby obtaining a titanium dioxide dispersion liquid.

Production of Ink Composition

Each of the materials was mixed in the content shown in Table 1, agitated for two hours at room temperature, filtered using a membrane filter having a pore diameter of 5 μm, and coloring inks (CMYK inks) and a background ink (W ink) were thereby produced. Note that the unit of content shown in Table 1 is mass %.

TABLE 1

| Ink | Coloring | | | | Background |
|---|---|---|---|---|---|
| Color | C | Y | K | M | W |
| Concentration of Solid Pigment | 4 | 5 | 5 | 4 | 10 |
| 1,2-hexanediol | 4 | 4 | 3 | 3 | 3 |
| 2-pyrolidone | 15 | 15 | 15 | 15 | 8 |
| Surfactant | 0.5 | 0.5 | 0.5 | 0.5 | 0.5 |

TABLE 1-continued

| Ink | Coloring | | | | Background |
|---|---|---|---|---|---|
| Color | C | Y | K | M | W |
| Styrene acrylic resin | 1 | 1.5 | 1.5 | 1 | |
| Polyester-based resin | | | | | 3 |
| Paraffin wax | 0.7 | 1 | 0.7 | 0.7 | 1 |
| Polyethylene wax | 0.2 | | 0.3 | 0.3 | 0.3 |
| Pure water | A remaining amount of 100 in total | | | | |

In Table 1 described above, as a styrene acrylic resin, an acrylic-styrene resin having Tg of 85° C. and an average particle diameter of 140 nm was used. In addition, as paraffin wax, AQUACER539 manufactured by BYK Chemie Japan, and as polyethylene wax, AQUACER513 manufactured by BYK Chemie Japan were used. In addition, as surfactant, BYK-348 manufactured by BYK Chemie Japan was used.

Test Method

Using the background ink (W ink) and the coloring inks described in Table 1 and the ink jet recording apparatus shown in FIG. 2 as well as the recording method disclosed in examples and comparative examples, a recorded product was produced. For an ink jet recording apparatus, the ink jet recording apparatus shown in FIG. 2 was produced by remodeling a part of PX-G930 manufactured by Seiko Epson Corporation. Recording conditions common in examples and comparative examples are as shown below.

Recording Method—Common Condition

Heating condition: The temperature of the platen was set to 60° C. In addition, hot air was blown onto the top face of the recording medium P from the hot air heater so that the surface of the recording medium P during recording was set to 50° C.

Drying process (only in examples): Drying was performed using the drying heater 43 so as to heat the recording medium P at 90° C. for 2 minutes. The drying rate of an image at that time was confirmed to be 60% or higher.

Recording medium P: IJ5363 (polyester) manufactured by 3M and LSPET manufactured by Sakurai Co., Ltd. were used.

Print pattern: The background ink (white ink) was recorded in a pattern of 100% duty or 50% duty. The coloring inks (CMYK inks) were recorded in a pattern of 10% to 100% duty. More specifically, a pattern in which two colors from YMCK are brought into contact with each other with 10% to 100% duty was recorded.

Herein, a pattern of duty is defined using the following equation.

$$\text{Duty}(\%)=\text{The number of actual printed dots}/(\text{Vertical resolution}\times\text{Horizontal resolution})\times 100$$

(Wherein, the "number of actual printed dots" is the number of dots that are actually printed per unit area, and the "vertical resolution" and the "horizontal resolution" are respectively resolution per unit area. 100% duty means the maximum mass of a single color ink with respect to a pixel.)

Example 1

In Example 1, a color pattern of 100% duty was recorded on a recording medium P using the coloring inks while the recording medium is transported in the T1 direction (first process), and a white pattern of 100% duty was further recorded thereon using the background ink (second process). Then, the recording medium was heated at 90° C. for 2 minutes using the drying heater 43 (drying process). Then, the recording medium P was wound back, and a color pattern of 100% duty was recorded using the coloring inks while being transported in the T1 direction (third process). Note that recording in the first and the second processes was performed by dividing the nozzle columns into two parts.

Example 2

In Example 2, a color pattern of 100% duty was recorded on the recording medium P using the coloring inks while the recording medium is transported in the T1 direction (first process). Then, the recording medium was heated at 90° C. for 2 minutes using the drying heater 43 (drying process). Then, the recording medium P was wound back, a white pattern of 100% duty was recorded thereon using the background ink (second process), and further, a color pattern of 100% duty was recorded thereon using the coloring inks while the recording medium is transported in the T1 direction (third process). Note that recording in the second and the third processes was performed by dividing the nozzle columns into two parts.

Example 3

In Example 3, a color pattern of 100% duty was recorded on the recording medium P using the coloring inks while the recording medium is transported in the T1 direction (first process), and a white pattern of 50% duty was further recorded thereon using the background ink (a part of the second process). Then, the recording medium was heated at 90° C. for 2 minutes using the drying heater 43 (drying process). Then, the recording medium P was wound back, a white pattern of 50% duty was recorded using the background ink while the medium is transported in the T1 direction (another part of the second process), and a color pattern of 100% duty was recorded using the coloring inks (third process). Note that recording in the first and a part of the second processes, and in another part of the second and the third processes were performed by dividing the nozzle columns into two parts.

Comparative Example

In Comparative Example, the first to the third processes were executed without performing the drying process during one transport operation of the recording medium P in the T1 direction. In other words, while the recording medium P was transported in the T1 direction, a color pattern of 100% duty was recorded using the coloring inks (first process), subsequently a white pattern of 100% duty was recorded using the background ink (second process), and further a color pattern of 100% duty was recorded using the coloring inks (third process). In order to execute this recording method, the nozzle columns in the recording head shown in FIG. 4 were used by being divided into three parts (for the first process, the second process, and the third process) along the transport direction T.

For the obtained recorded products, the image quality thereof was evaluated in light of bleeding of images and color cohesion. The results of Examples 1 to 3 and Comparative Example are shown in Table 2 below.

TABLE 2

| | Bleeding of Image | | Color Cohesion | |
|---|---|---|---|---|
| Recording Medium | IJ5363 | LSPET | IJ5363 | LSPET |
| Example | ○ | ○ | ○ | ○ |
| Example | ○ | ○ | Δ | ○ |
| Example | Δ | ○ | Δ | ○ |
| Comparative Example | X | Δ | X | Δ |

Evaluation was visually performed, and images on both the front and rear sides were determined together. Evaluation criteria are as follows.

○: None

Δ: A little shown as a high duty portion (80% or higher) of a color image x: A little shown as a low duty portion (less than 80%) of a color image According to the results shown in Table 2, By arranging the drying process in the first to the third processes, image quality with excellence in both of bleeding of an image and color cohesion could be obtained. In addition, in the examples, high image quality was obtained in order of Example 1, Example 2, and Example 3.

In Example 1, the first coloring ink of the first process and the background ink of the second process were printed at the same time, and drying was performed for the background ink with a drying rate of 60% or higher, and accordingly, the background ink played a role of an absorbing layer that absorbs the second coloring ink of the third process, and bleeding and color cohesion in a recorded portion caused by the second coloring ink were generated a little.

In Example 2, since the drying rate of the background ink was not 60% or higher, bleeding and color cohesion in a recorded portion caused by the second coloring ink were worse than in Example 1.

In Example 3, since the second process is divided, bleeding and color cohesion in a recorded portion caused by the background ink of the second process, the first coloring ink of the first process, and the second coloring ink of the third process were slightly worse than in Examples 1 and 2.

What is claimed is:

1. An ink jet recording method comprising:

a first process in which a coloring ink is recorded on a recording medium using an ink jet head so as to form a first image;

a second process in which a background ink is recorded using the ink jet head so as to form a background image that covers the first image; and a third process in which a coloring ink is recorded using the ink jet head so as to form a second image, wherein a drying process is included between the first process and the third process.

2. The ink jet recording method according to claim 1, wherein the drying process is performed between the second process and the third process.

3. A recording apparatus that uses the ink jet recording method according to claim 2.

4. The ink jet recording method according to claim 1, wherein the drying process is performed until a drying rate of an image formed on the recording medium reaches 60% or higher.

5. A recording apparatus that uses the ink jet recording method according to claim 4.

6. The ink jet recording method according to claim 1, wherein the first and the second processes are performed using an ink jet head, and executed at the same time as a transport operation of the recording medium in a first direction, and wherein the third process is executed at the same time as a transport operation of the recording medium in the direction opposite to the first direction, or after the transport operation in the opposite direction has been completed.

7. A recording apparatus that uses the ink jet recording method according to claim 6.

8. The ink jet recording method according to claim 1, wherein the ink jet head includes a plurality of nozzle columns that extend in the transport direction of the recording medium, and the plurality of nozzle columns has nozzle columns in which nozzle holes that discharge the coloring inks are arranged and nozzle columns in which nozzle holes that discharge the background ink are arranged, wherein, in the first or the third process, the coloring ink is recorded using nozzle holes of a first group in the nozzle columns of the coloring ink, wherein, in the second process, the background ink is recorded using nozzle holes of a second group in the nozzle columns of the background ink, and wherein the first group and the second group are differently positioned in the transport direction.

9. A recording apparatus that uses the ink jet recording method according to claim 8.

10. The ink jet recording method according to claim 1, wherein the coloring ink or the background ink is an aqueous ink containing a color material and a resin.

11. A recording apparatus that uses the ink jet recording method according to claim 10.

12. The ink jet recording method according to claim 1, wherein the recording medium has light transmissivity.

13. A recording apparatus that uses the ink jet recording method according to claim 12.

14. A recording apparatus that uses the ink jet recording method according to claim 1.

* * * * *